US006406351B1

(12) United States Patent
Chen

(10) Patent No.: US 6,406,351 B1
(45) Date of Patent: Jun. 18, 2002

(54) CUP STRUCTURE FOR BRA

(75) Inventor: Chung-Chin Chen, Tainan Hsieh (TW)

(73) Assignee: Shian Shun Enterprise Co, Ltd., Tainan Hsieh (TW)

( * ) Notice: Subject to any disclaimer, the term of this patent is extended or adjusted under 35 U.S.C. 154(b) by 0 days.

(21) Appl. No.: 09/978,074

(22) Filed: Oct. 17, 2001

(51) Int. Cl.[7] ..... A41C 3/00
(52) U.S. Cl. ..... 450/55; 450/57
(58) Field of Search ..... 450/55, 57, 53, 450/54, 56; 2/267, 268

(56) References Cited

U.S. PATENT DOCUMENTS 2,440,466 A * 4/1948 Freedman ..... 450/57
2,620,484 A * 12/1952 Gerry ..... 2/268
2,867,818 A * 1/1959 Creamer ..... 450/57
2,891,544 A * 6/1959 London ..... 450/57
5,189,738 A * 3/1993 Mitchell ..... 2/268
5,340,352 A * 8/1994 Nakanishi et al. ..... 450/57

* cited by examiner

*Primary Examiner*—Gloria M. Hale
(74) *Attorney, Agent, or Firm*—Rosenberg, Klein & Lee

(57) ABSTRACT

A cup structure for a bra includes an outer layer (10) made of netted cotton fabric, a foam layer (20) connected to an inside of the outer layer and an inner lining (30) connected to the foam layer. The outer layer and the foam layer are flexible at all directions so as to mate with the breasts of a wearer. The cup is made to have a shape and this shape can be maintained because the flexibility of the outer layer and the foam layer.

1 Claim, 8 Drawing Sheets

CUP STRUCTURE FOR BRA

The present invention relates to a cup structure for a bra, and more particularly, to a cup structure including a netted cotton layer, a foam layer with low density and an inner lining. The netted cotton layer and the foam layer are flexible in all directions so that the cups of the bra maintain a certain shape according to the breasts of the wearer.

A conventional cup for a bra is shown in FIGS. 7 and 8 and generally includes outer layer 40, a foam layer 50 and an inner lining. The foam layer 50 is located between the outer layer 40 and the inner lining. The outer layer 40 is made of fabric which is woven in a single direction so that it can only has one directional tension. In other words, the outer layer 40 has a limited flexibility. The foam layer 50 is made of material having high density because it is required to form a certain shape to enclose the wearer's breasts. However, the foam layer 50 with high density has a worse air-permeability and is not soft enough for the breasts. The conventional cups cannot meet different wearers' requirements because the foam layer 50 cannot mate with the shape of breasts so that there is a gap between the breast and the cup as shown in FIG. 8. The gap results in scraping and makes uncomfortable for the wearers. Besides, because of the stiffness of the foam layer 50, the foam layer 50 tends to deform after washing or scrubbing.

The present invention intends to provide a cup structure including flexible outer layer and foam layer. The cup has fill flexible so that it maintains the desired shape after being washed.

In accordance with one aspect of the present invention, there is provided a cup structure for a bra and comprising an outer layer, a foam layer and an inner lining. The outer layer is made of netted cotton fabric and is flexible at all directions. The foam layer is connected to an inside of the outer layer and is made of low density foam material. The foam layer is flexible at all directions.

The object of the present invention is to provide a cup structure for a bra wherein the cup shape can be maintained by the flexibility of the outer layer and the foam layer.

These and further objects, features and advantages of the present invention will become more obvious from the following description when taken in connection with the accompanying drawings which show, for purposes of illustration only, several embodiments in accordance with the present invention.

IN THE DRAWINGS

Figure 1:
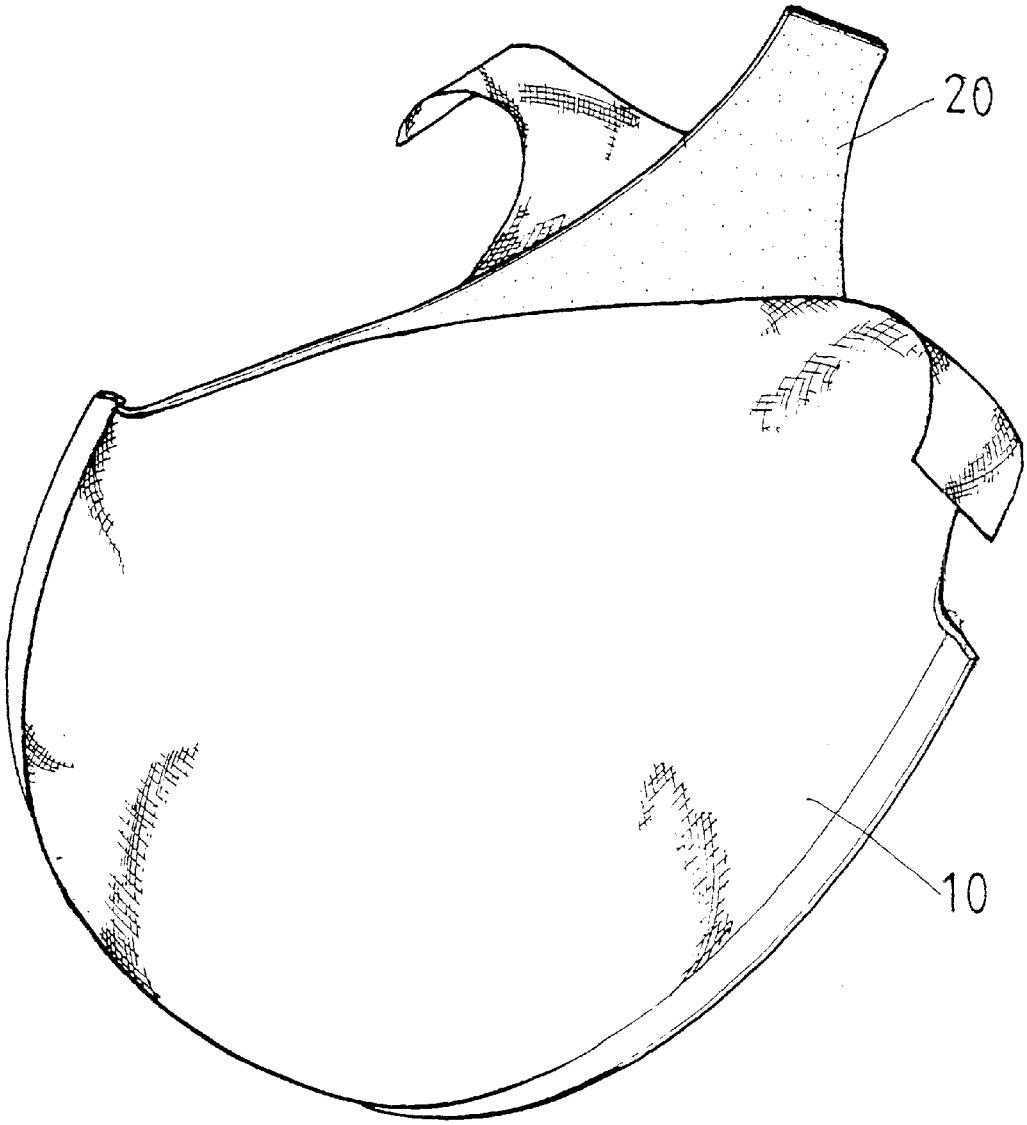
FIG. 1 is an illustrative view to show three layers of a bra cup of the present invention.
Figure 2:
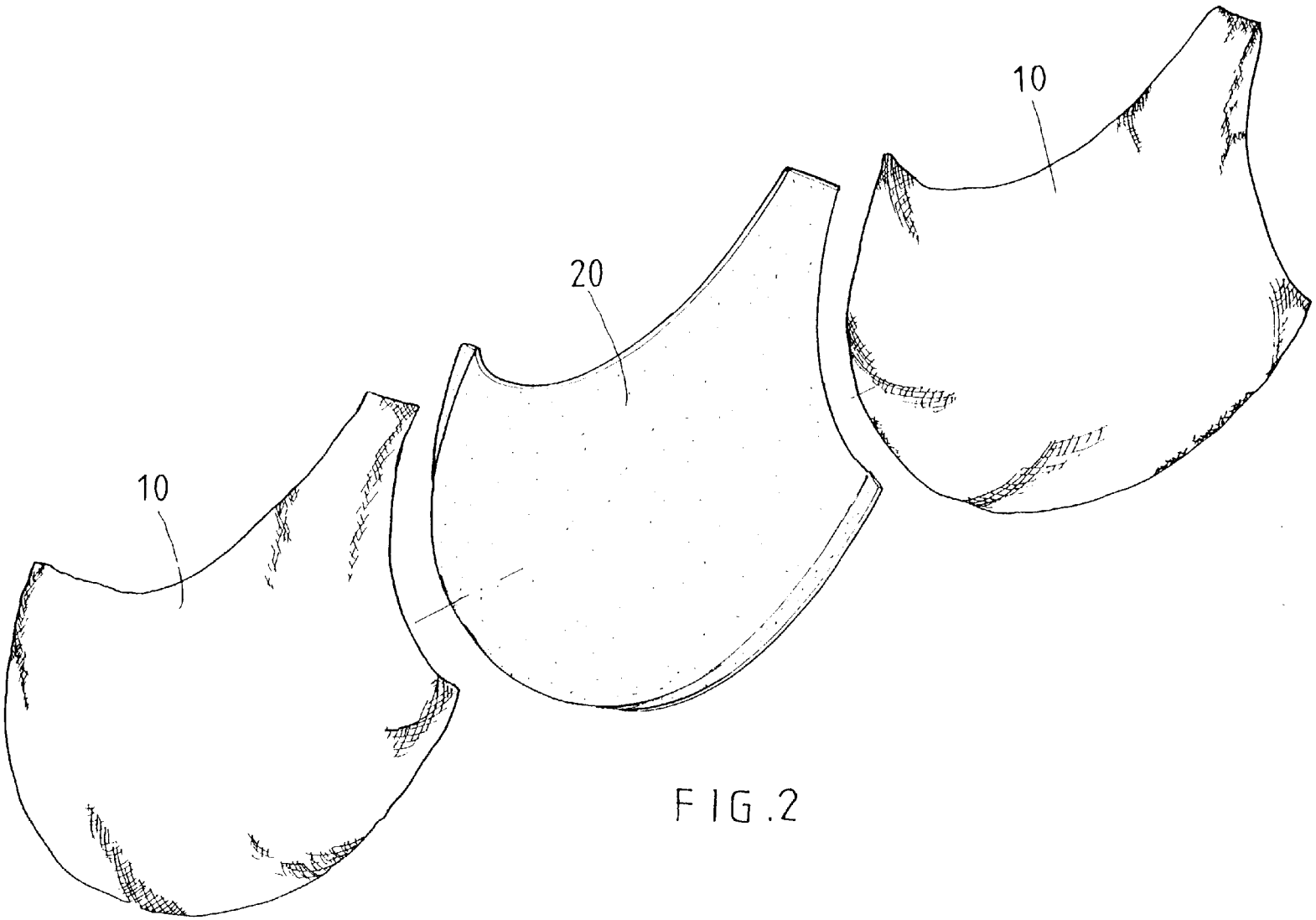
FIG. 2 is an exploded view to show the three layers of the bra cup of the present invention.
Figure 3:
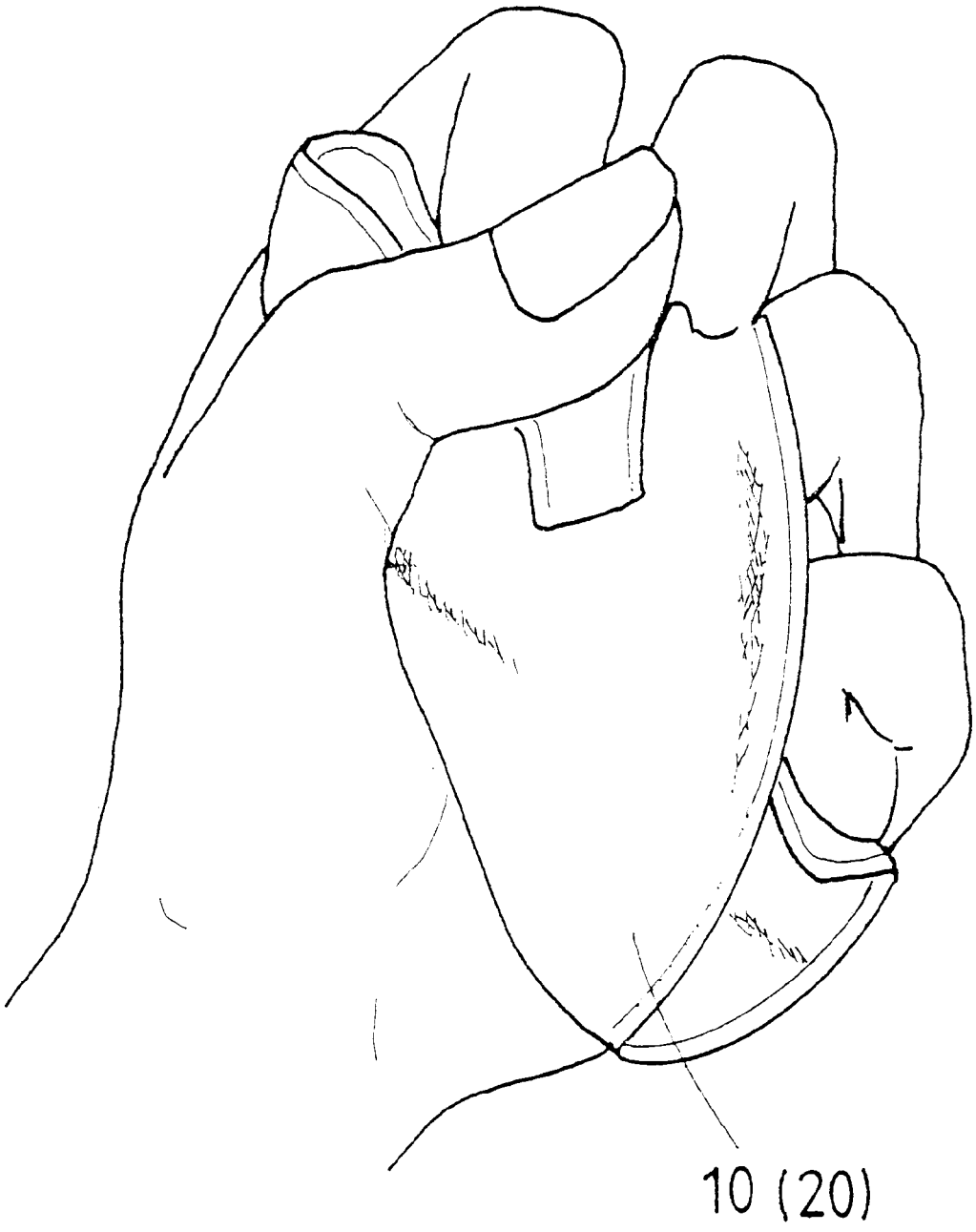
FIG. 3 is an illustrative view to show the bra cup is grasped by a hand to show the softness and flexibility.
Figure 4:
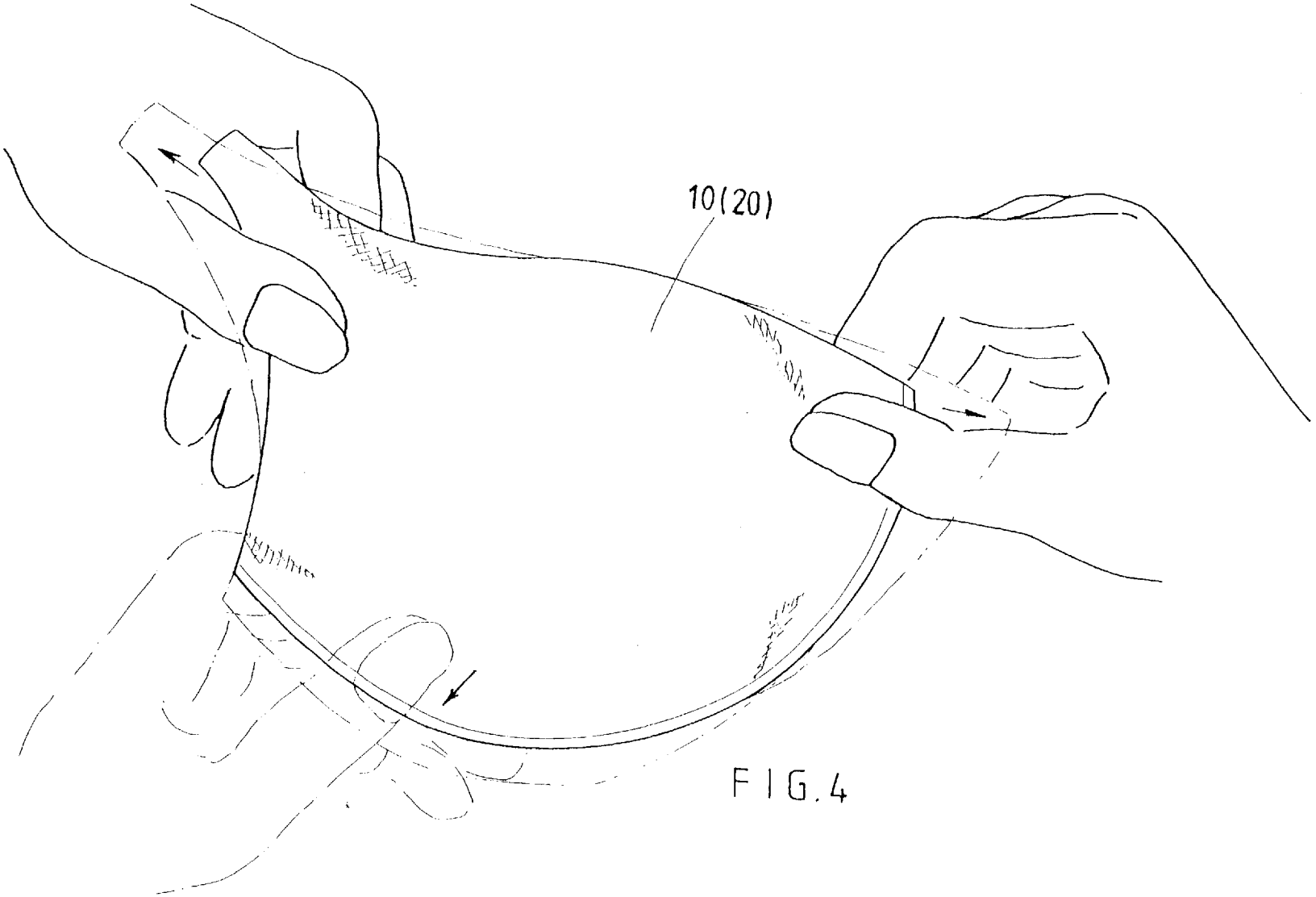
FIG. 4 is an illustrative view to show the bra cup is flexible at all directions.
Figure 5:
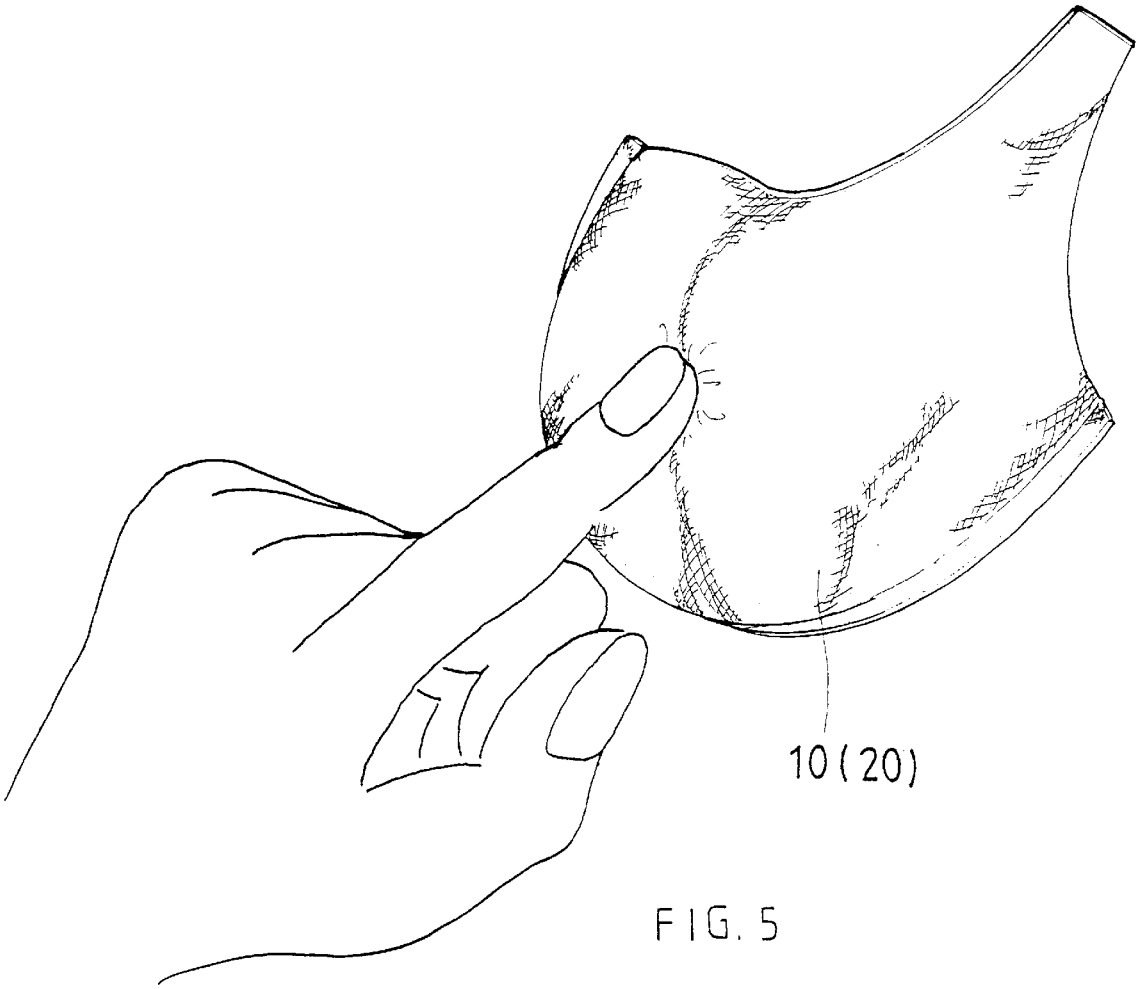
FIG. 5 is an illustrative view to show the bra cup is soft and flexible.

Referring to FIGS. 1 and 2, the bra cup in accordance with the present invention comprises an outer layer 10 which is made of netted cotton fabric and is flexible at all directions. A foam layer 20 is connected to an inside of the outer layer 10 and is made of low density foam material. The foam layer 20 is flexible at all directions. An inner lining 30 is connected to the foam layer 20. The cup of the present invention can be stretched at all the directions as shown in FIG. 4 and is flexible such as shown in FIGS. 3 and 5. The outer layer 10, the foam layer 20 and the inner lining 30 are all air-permeable.

Figure 6:
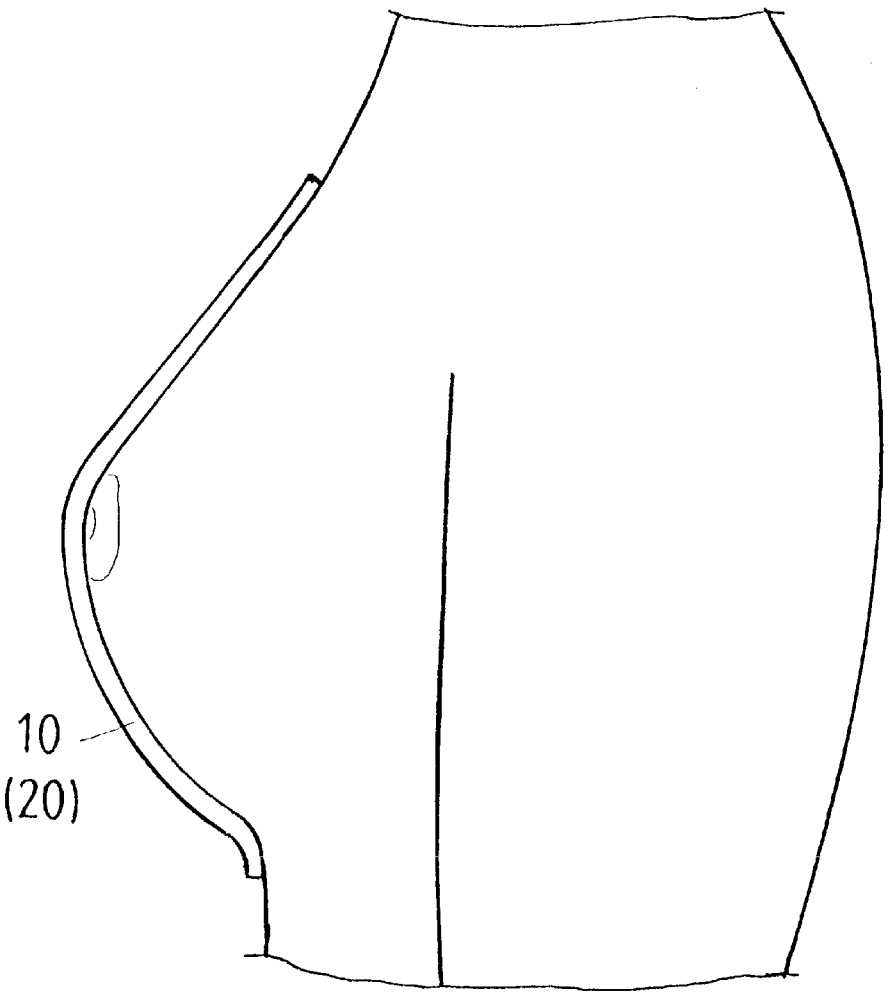
FIG. 6 is an illustrative view to show the bra cup mates with the shape of a wearer's breast.
Figure 7:
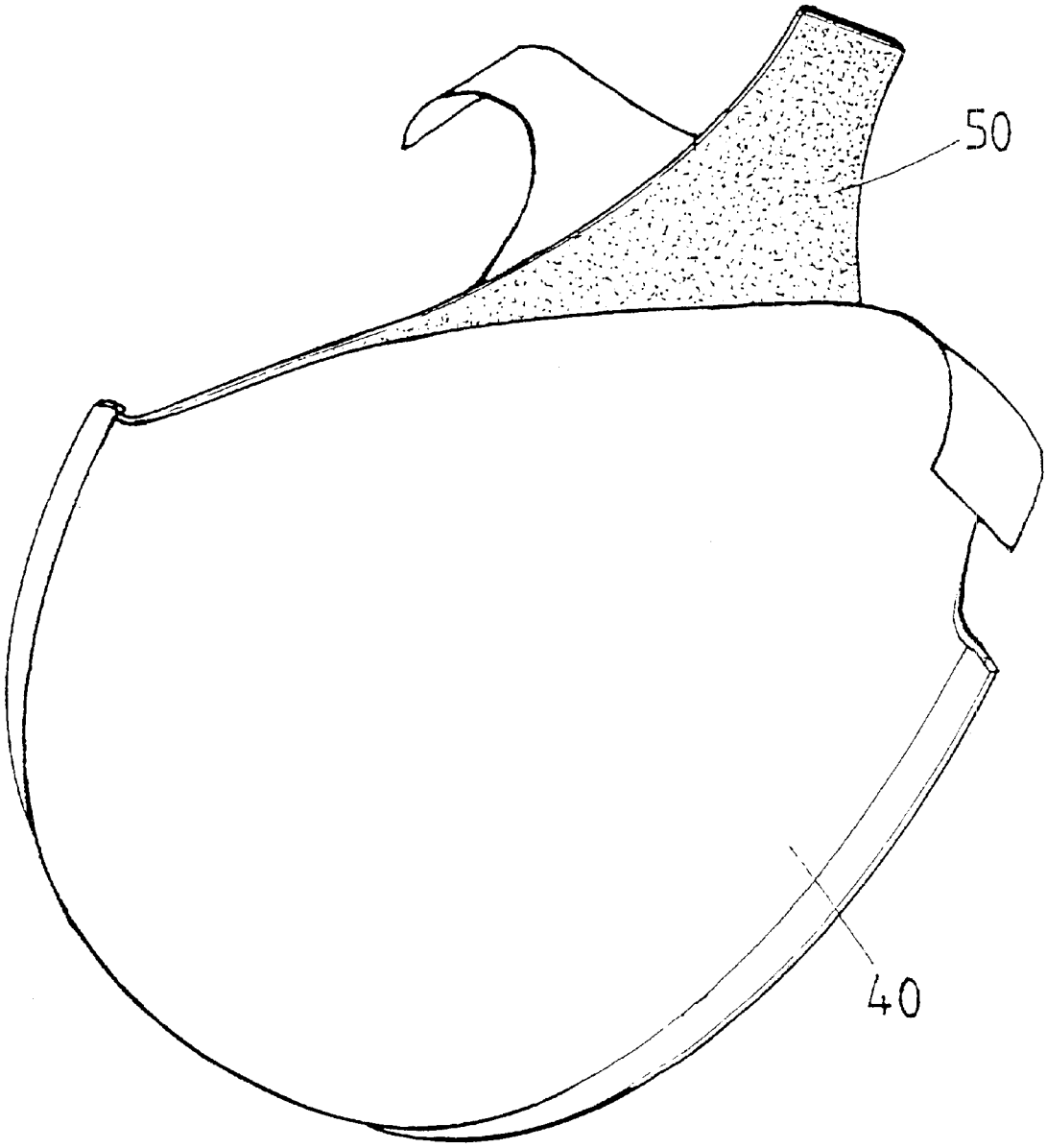
FIG. 7 is an illustrative view to show three layers of a conventional bra cup.
Figure 8:
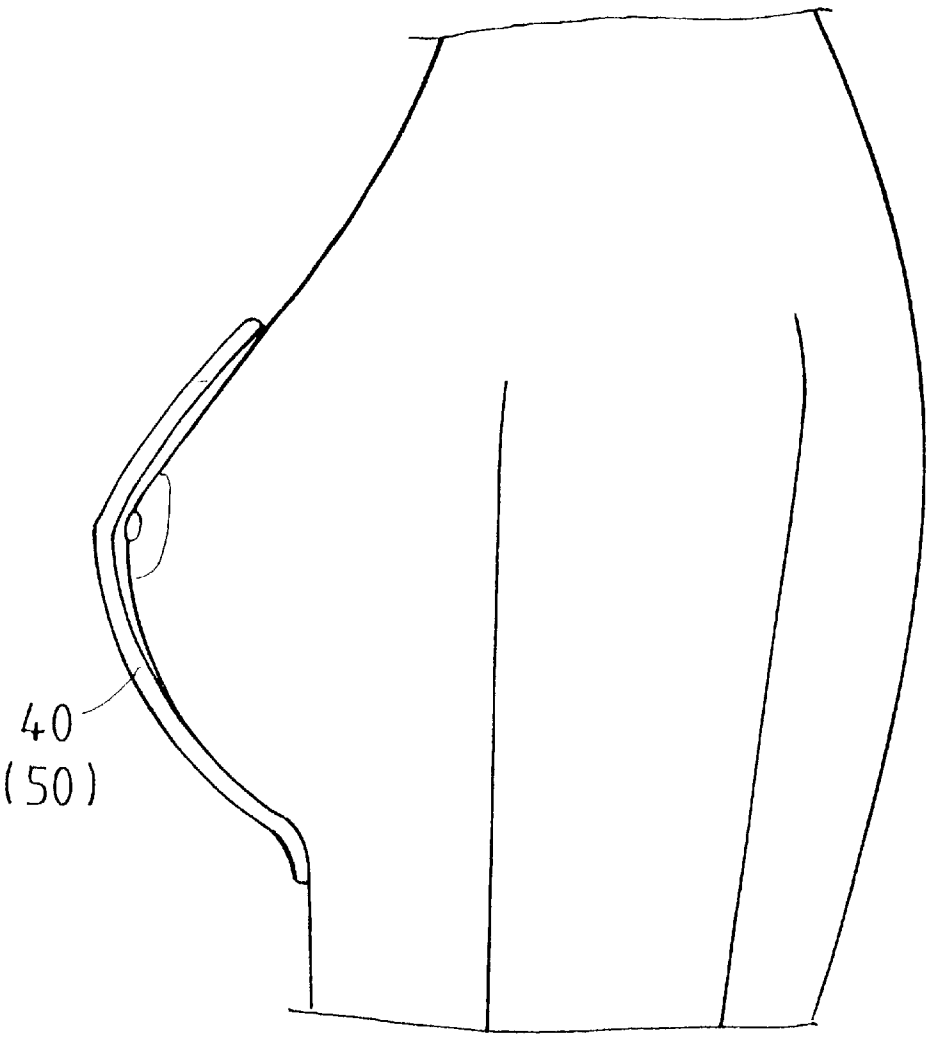
FIG. 8 is an illustrative view to show the conventional bra cup and a gap is defined between a wearer's breast and the cup.

As shown in FIG. 6, the cup of the present invention can mate with the shape of the breast and provide a better enclosure and support. The flexibility of the cup makes the cup to maintain the shape even if it is washed.

While we have shown and described various embodiments in accordance with the present invention, it should be clear to those skilled in the art that further embodiments may be made without departing from the scope and spirit of the present invention.

What is claimed is:

1. A cup structure for a bra, comprising:

an outer layer which is made of netted cotton fabric and is flexible in all directions;

a foam layer connected to an inside of said outer layer and made of low density foam material, said foam layer being flexible in all directions, and an inner lining connected to said foam layer.

* * * * *